United States Patent [19]

Martin

[11] Patent Number: 4,462,951

[45] Date of Patent: Jul. 31, 1984

[54] METHOD AND APPARATUS FOR CONSTRUCTING MULTI-STORIED CONCRETE BUILDINGS

[76] Inventor: Fred E. Martin, 506 Malaga, Apt. #1, Coral Gables, Fla. 33134

[21] Appl. No.: 476,032

[22] Filed: Mar. 17, 1983

[51] Int. Cl.[3] ..... B28B 13/06

[52] U.S. Cl. ..... 264/334; 249/28; 264/33; 264/271.1; 425/62

[58] Field of Search ..... 264/31, 33, 334, 271.1; 249/28; 425/62; 52/741

[56] References Cited

U.S. PATENT DOCUMENTS

| | | | |
|---|---|---|---|
| 3,450,280 | 6/1969 | Colnot | 264/34 |
| 3,788,494 | 1/1974 | Markewitz et al. | 425/62 |
| 3,966,164 | 6/1976 | Dashew | 425/62 |
| 3,977,536 | 8/1976 | Moore et al. | 425/62 |
| 4,003,541 | 1/1977 | Lanier | 425/62 |

FOREIGN PATENT DOCUMENTS

| | | | |
|---|---|---|---|
| 1449969 | 11/1967 | France | 425/62 |
| 7500092 | 7/1975 | France | 425/62 |

*Primary Examiner*—Donald E. Czaja
*Assistant Examiner*—James C. Housel
*Attorney, Agent, or Firm*—Jack E. Dominik

[57] ABSTRACT

Disclosed is a method and apparatus for extracting large form panels used in forming floor slabs on poured-in-place, multi-story concrete structures from beneath the slab they last formed. The preferred embodiment apparatus, called a panel picker, includes a frame held by a crane above and adjacent to the last formed slab; the frame is anchored to the slab and contains hoists on movable trolleys for attaching to and lifting the form panel. The movement of the trolleys permits attachment to the panel picker to be made in two steps and without the panel being unsupportedly cantilevered out to where a crane could attach directly to the panel.

3 Claims, 13 Drawing Figures

METHOD AND APPARATUS FOR CONSTRUCTING MULTI-STORIED CONCRETE BUILDINGS

BACKGROUND OF THE INVENTION

1. Field of the Invention

This invention relates to a method and apparatus for formation of reinforced concrete slabs (floors) in a multi-storied building, and, in particular, to the movement of the slab form panels from story-to-story.

2. Description of the Prior Art

When erecting multi-story, poured-in-place concrete structures, it is advantageous to make up slab form panels large enough to form an entire bay or large enough to approach the safe lifting capacity of the job crane. In addition to providing consistent quality of the slab surface, the goals of any system designed to accomplish this include:

reduced time on slab forming;
reduced labor costs on slab forming;
reduced costs of the equipment;
increased safety for the workmen;
increased safety for the structure;
reduced weight of the equipment;

The most important feature of any such system is quality and efficiency of movement of the form panels from floor-to-floor.

Dave, U.S. Pat. No. 2,966,718 describes a system of form panels which are moved about on an adjustable carrier and transferred from floor-to-floor up a temporary ramp through a temporary hole left in the slab. The panels are restricted in size as they all must be maneuvered around columns and walls to the base of the ramp. As a result more joints between panels increase the labor in dealing with them. Also, considerable labor is involved in dismantling, moving, and erecting the ramp, forming the slab edges around the temporary opening, and forming the remainder of the slab to fill in the opening after the panels have been raised. The additional cost of overcoming the discontinuity of the reinforcing steel and concrete at the opening must also be considered.

Quentin, U.S. Pat. No. 3,482,005 involves temporary loading platforms which extend outside the building edge. Rolling form panels are maneuvered onto these platforms to enable attachment of the crane cable to the center of gravity of the form panel for lifting to the next floor. The length of the panel is restricted by the length of the platform extension and the cost and weight of the platform increases exponentially as one attempts to use a longer panel. Whether the panels are moved with a few platforms set several times, or several platforms set a few times, the additional time, labor and materials is still costly and dangerous.

Colnot, U.S. Pat. No. 3,450,280 mentions in his description of the prior art a 'C' shaped or fork style hoist line implement which can reach around underneath the poured-and-cured floor slab edge and attach to the center of gravity of the form panel. By locating the crane cable vertically in line with the same center of gravity it maintains the panel in horizontal attitude when it is lifted inches clear of the floor on which it rests, to allow for lateral movement by the crane out from under the slab it had just previously formed. Colnot goes a step further by devising a boom-like hoist line implement which attaches to the projected end of a form panel and extends over the last poured slab above to an intersection with a vertical line through the center of gravity of the panel. The crane cable is attached at this intersection, a slight vertical lift clears the panel from the floor on which it rests, and the crane moves the panel out from under the floor last formed. Such a device develops higher tension and compression loads at the boom-panel connections than the total weight of the panel itself. It requires a skillful crane operator to move more than half the length of the panel laterally without jamming it between the columns on the side of the bay, or between the floor and ceiling. The panel must also be strong enough to resist bending for more than half its length. Such a need has led to the use of a parallel chord truss as the primary longitudinal beam in the form panel configuration, which is costly and heavy. Again, it is noted as the length of the panel (and so the boom) increase, the weight and cost of both increase exponentially.

It was soon discovered that this form panel now composed of parallel chord trusses, designed to resist bending in more than half its length, could be extracted from under the slab without Colnot's boom at all. Floor mounted rollers contacting the bottom chord of the truss enable the panel to be pushed out from under the slab. When the center of gravity of the panel has cleared the last roller at the edge of the slab the outer end of the panel begins to tip down until the top of the tail end jams against the ceiling. Since the center of gravity has cleared the edge of the slab above, the crane cable can now be attached directly to the panel at the center of gravity. As the crane lifts upward the panel returns from the tipped-down to a horizontal attitude and then begins to clear the floor on which it rested. Once clear of the floor the crane moves the remaining half of the panel laterally until it has cleared and slab edge and can be lifted vertically to the next floor. At the point of tip-down, when the center of gravity of the panel has passed the last roller at the edge of the slab, the entire weight of the panel is concentrated on that delicate point of the structure. As the panel continues out past tip-down a leverage effect increases that load in addition to an uplift load at the tail end of the panel. There is also a loose collection of jacks, rollers and dollies which require time and labor to move from panel to panel as the panel extraction progresses.

Avery, U.S. Pat. No. 3,899,152 proposes the use of specialized extruded aluminum 'I' beams as the material from which to fabricate the truss in an attempt to reduce the weight. Not only is the panel still heavy, but lacks in resiliency compared to steel, and is expensive due to the aluminum and the specialized shape.

Daskew, U.S. Pat. No. 3,966,164 and Moore, U.S. Pat. No. 3,977,536 attempt to make the truss system more workable by increasing the ease of adjustment and maneuverability. The basic problems with the system still exist and these improvement ideas decrease labor but increase material cost.

Strickland, U.S. Pat. No. 3,504,879 describes an adjustable jack with a top roller which is bolted near the top of previously poured concrete columns on each side of a bay as supports for a form panel. Instead of the truss mentioned above as a primary girder in the panel, he uses a very deep wide flange steel beam with the same resistance to bending as the truss. The panel is pulled out of the building on the rollers and tips down when the center of gravity of the panel has passed the last column-jack-roller. The same concentrated loads have to be delt with but this time on less-than-fully-cured-columns, instead of the slab edge. Since the primary beams in the panel have to be at the outer edge of the panel, the joists or secondary beams in the panel have to span further and, therefore, be stronger and heavier than a joist supported at approximately one quarter and third quarter points. Such a panel is heavier than an aluminum truss panel of comparable size and has very limited adjustment for width. It requires sleeving of the column as well as mounting and dismounting of the cumbersome roller jacks. As a result of the inherent problems, such a system has relatively specialized usage.

SUMMARY OF THE INVENTION

This invention provides a method and apparatus for extracting large form panels used in forming floor slabs on poured-in-place, multi-story concrete structures from beneath the slab they last formed. The preferred embodiment apparatus, called a panel picker, includes a frame held by a crane above and adjacent to the last formed slab; the frame is anchored to the slab and contains hoists on movable trolleys for attaching to and lifting the form panel. The movement of the trolleys permits attachment to the panel picker to be made in two steps and without the panel being unsupportedly cantilevered out to where a crane could attach directly to the panel.

This invention also provides for form panels which are lighter than other large form panel systems used today because the panel need not be as inherently strong due to the inventive method of extraction. As a result the panel configuration is much less complex and, therefore, less expensive. Panel assembly is faster and easier thereby saving time and make-up labor. Each preferred embodiment panel leg has a permanent swivel caster for lateral movement and a permanent screw jack for vertical movement requiring no loose parts as with other systems used today resulting in lower direct labor costs, less time due to eliminated steps, and less expense due to lost parts. Further, the panel has telescoping shores to support the weight of the concrete and thereby permits use of lighter legs, casters, and screw jacks.

This extraction system does not require the form panel to cantilever over half its length beyond the structure which puts a potentially damaging and dangerous strain on the edge of the slab of the structure. Once the panel picker is flown into position and anchored to the slab, the panel is extracted and loaded totally by the hookers without movement of the crane cable. Such an advantage allows use of a less experienced crane operator perhaps for less wages and results in a safer, more controlled loading sequence. The overall simplicity of this system makes it more adaptable to other than typical situations and the overall cost savings make it more feasible on low reuse projects.

DESCRIPTION OF A PREFERRED EMBODIMENT

Figures 1, 2:
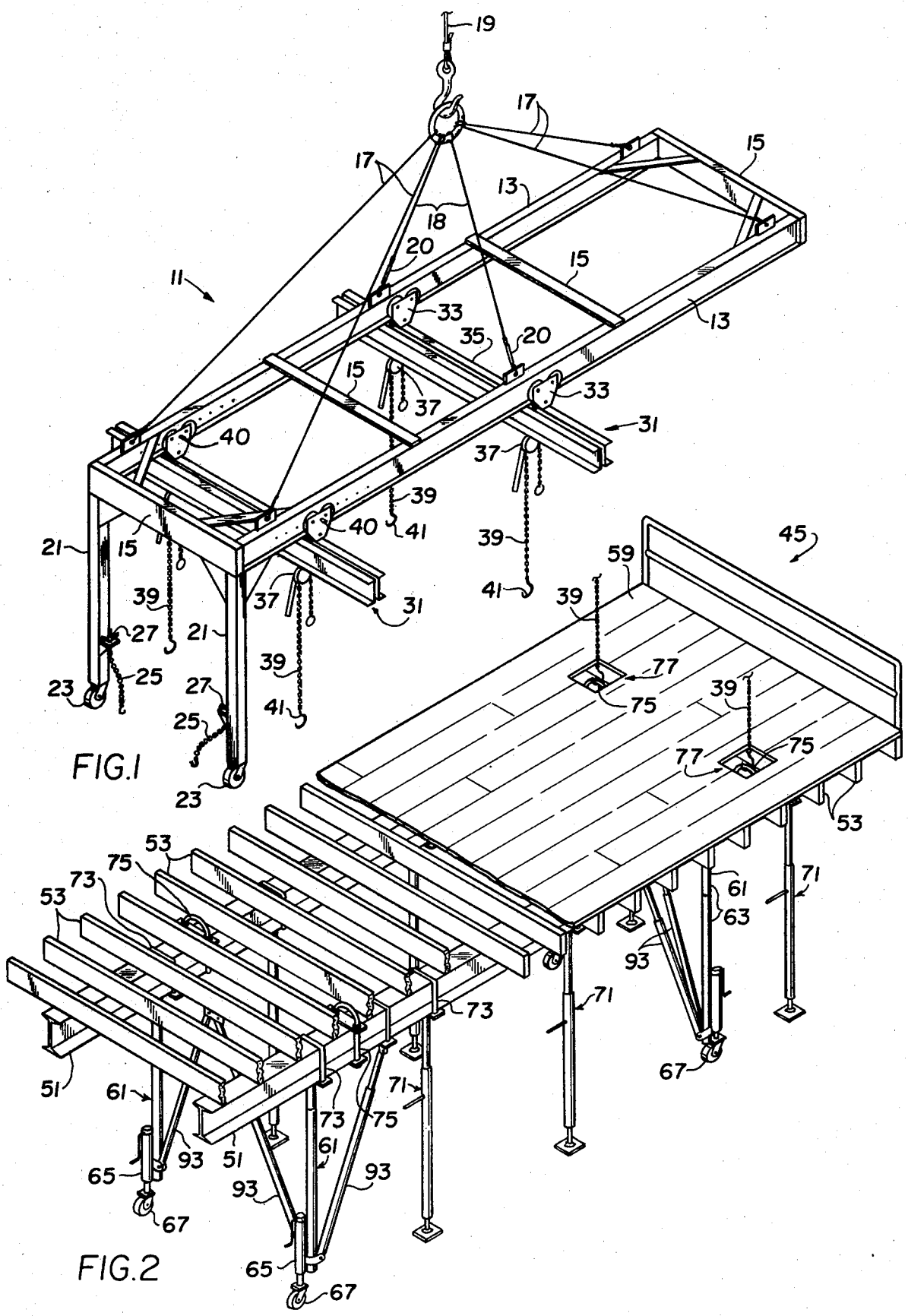
FIG. 1 shows a perspective view of a preferred embodiment of the panel picker apparatus.
FIG. 2 shows a partially broken away perspective view from the rear of a preferred embodiment of the form panel.
Figure 11:
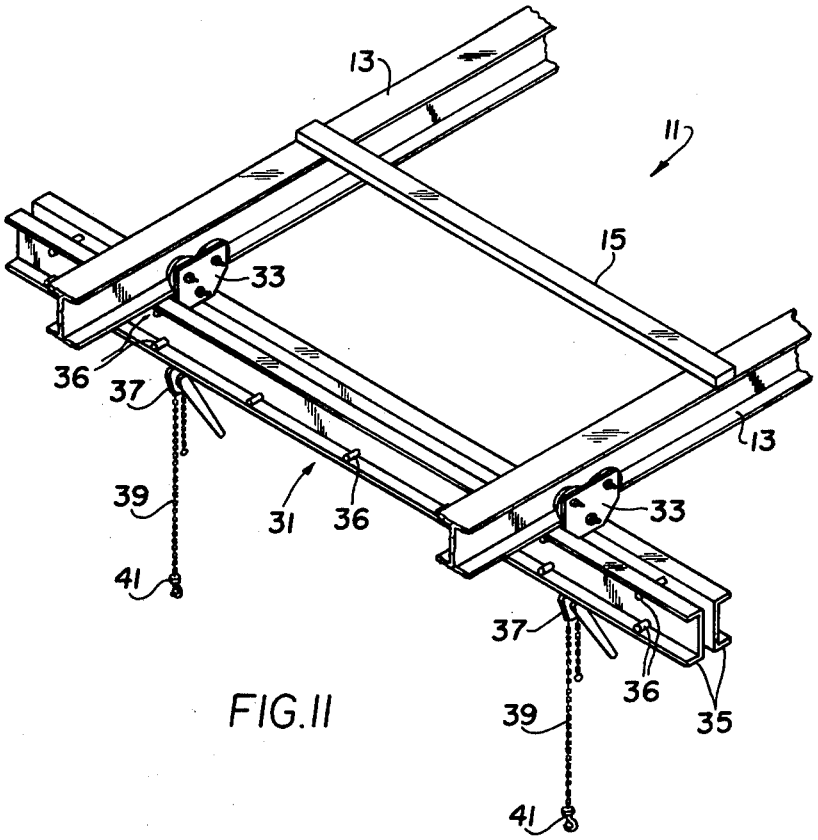
FIG. 11 shows a perspective view of the trolley-spreader beam-hoist assembly of the picker of FIG. 1.

The panel picker 11 shown in FIG. 1 is an apparatus used to extract form panels from under the slab they last formed. Picker 11 is composed of two metal I-beams 13 held apart and braced by metal cross members 15. A convenient size for the picker 11 when used to move large concrete floor slab form panels is 40 foot I-beams 13 and 8 foot cross members 15. This rectangular frame is supported from the main crane cable 19 using a six-way harness 17 attached to the top of I-beams 13. The interior cables 18 are adjusted by turnbuckles 20 so that the deflection of I-beams 13 is minimized. At one end of each I-beam is a fixed or folding leg 21 which has a heavy duty wheel 23 attached to the bottom end. Adjacent to each of these wheels is a chain 25 and an eye bolt plus wing nut 27 for connecting panel picker 11 to insert 29 imbedded in the slab during the loading process of the form panel onto picker 11 and for releasing picker 11 after the panel is loaded, as described in detail below. Suspended from the bottom flanges of I-beams 13 are at least two trolley-spreader beam-hoist assemblies 31 which move linearly along the I-beams. As shown in FIG. 11 assembly 31 consists of a pair of standard trolleys 33, one on each I-beam 13 bottom flange, spreader beam 35 (which is a pair of channels held spaced apart by welded pins 36) held by trolleys 33, and a pair of hoists 37 held by spreader beam 35. Spreader beams 35 allow hoists 37 to be moved together or apart to accommodate different width form panels by just hooking onto the appropriate pins 36. Similarly, spreader beam 35 is held by trolleys 33 hooking pins 36 and may be easily and quickly removed and replaced. At the ends of the hoist line cables 39 is a hook 41 for attachment to the pick-up bracket on the primary girder of the form panel, as described in detail below. Pins 40 through trolley 33 and I-beam 13 hold assembly 31 which is closest to legs 21 from movement as described below. Either trolleys 33 or hoists 37 or both may be electrically powered to ease movement during operation as described below.

The form panel 45 shown in FIG. 2 consists of two or more primary girders 51 running the length of the panel supporting a plurality of joists 53 running perpendicular to the girders which in turn support the form sheeting 59 (shown partially broken away). Typical sizes for form panel 45 are from 10 to 20 feet wide and 20 to 80 feet long. The form panel is supported by and rolled about on a minimum of four legs 61 bearing on primary girders 51, each consisting of telescopic tubes 63 for a wide range of rough adjustment, a screw jack 65 for fine adjustment and lowering of panels 45, and a swivel caster 67 for lateral movement (see FIG. 10). Along primary girders 51 at regular intervals are heavy duty shores 71 used to support the panel during the concrete loading. Shores 71 consist of telescoping tubes for rough adjustment and a turnbuckle type action for fine adjustment. U-bolts 73 which clamp bracket 95 onto the primary girder 51 at any location provide a fast attachment-detachment for legs 61 and shores 71. Form panel 45 is also provided with heavy-duty pick-up U-bolts 75 which clamp to primary girders 51 slightly ahead of legs 61 to permit a safe quick connection to hoist lines 39 on panel picker 11, as described below. U-bolts 75 are accessible through knock-out access doors 77.

Figure 3:
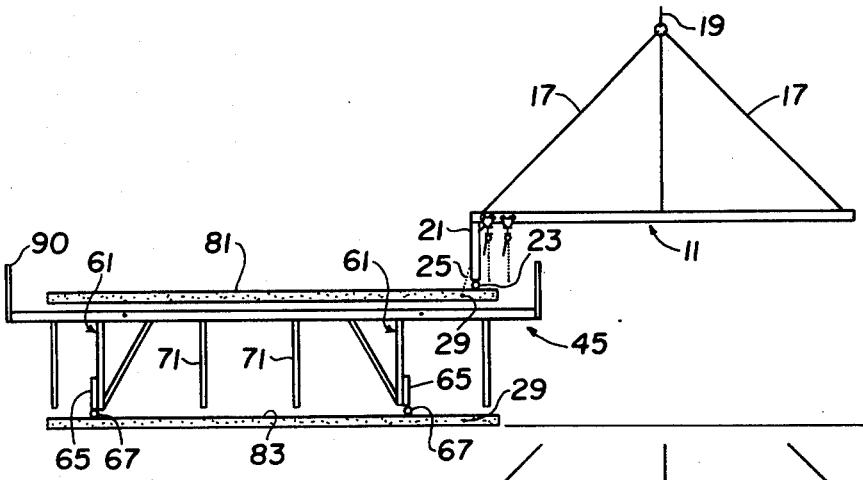
FIG. 3 shows the FIG. 2 form panel lowered away from the slab it last formed and the FIG. 1 panel picker attached to the same slab ready for the loading of the panel.
Figure 4:
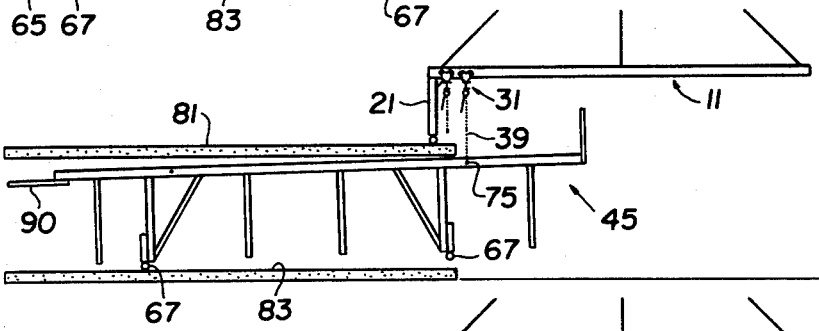
FIG. 4 shows the panel rolled out to the first pick-up position, attached to the picker and raised so that weight of the panel which was supported by the front wheels of the panel is now supported by the front trolley-spreader beam-hoist on the panel picker.
Figure 5:
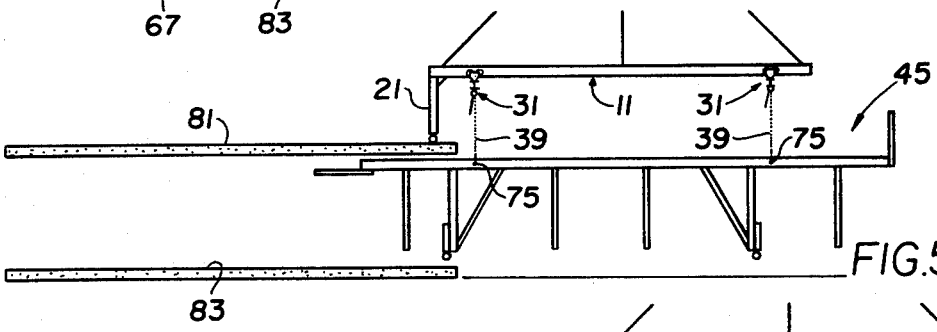
FIG. 5 shows the panel rolled out to the rear pick-up position, attached to the picker and raised so the entire weight of the panel is supported by the panel picker in a balanced position in relation to the main crane cable.
Figure 6:
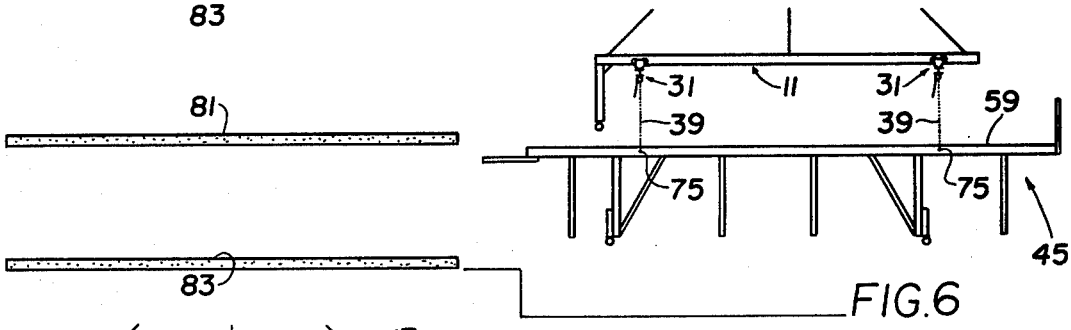
FIG. 6 shows the panel/panel picker combination detached from the slab and moved laterally by the crane enough to clear the structure thereby permitting vertical movement.
Figure 7:
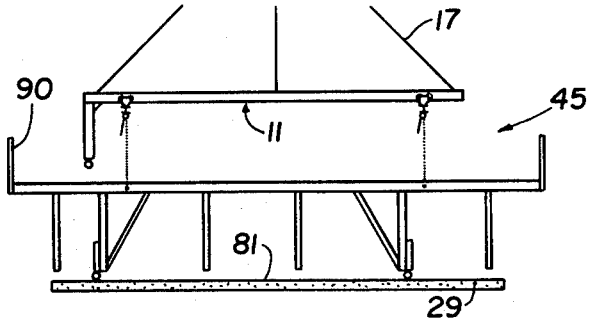
FIG. 7 shows the panel/panel picker combination moved vertically and back laterally for depositing the panel on the next floor up.
Figure 7:
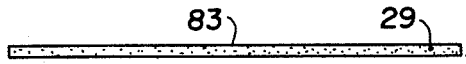
Figure 13:
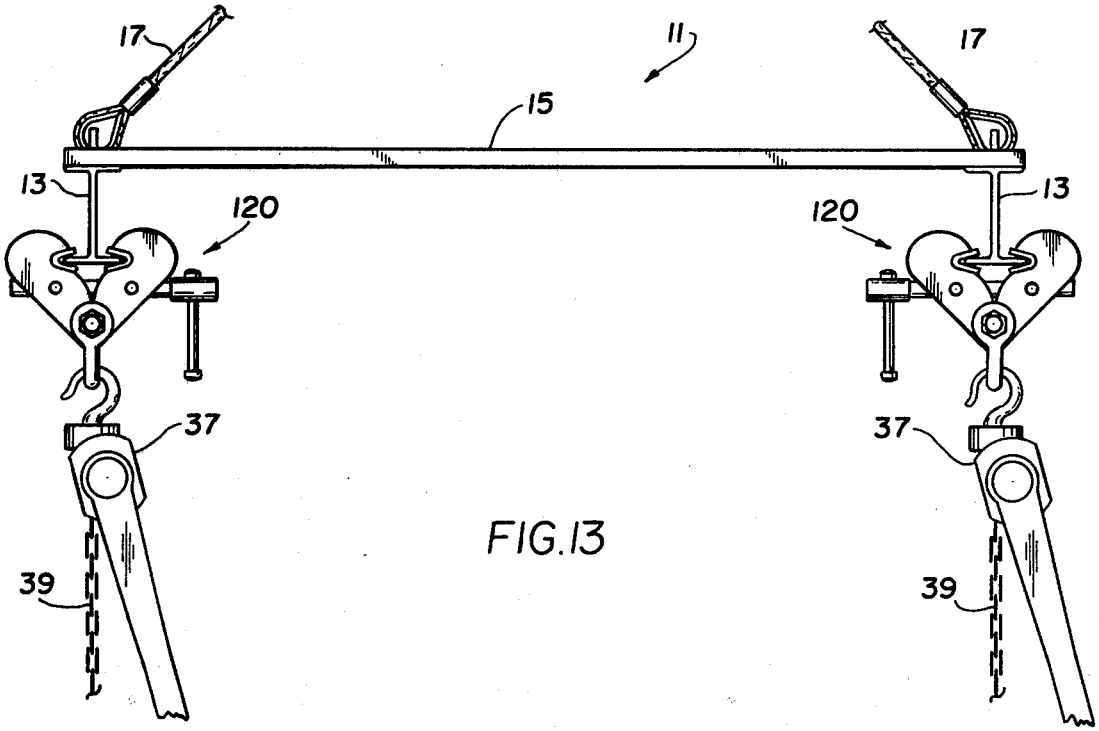
FIG. 13 shows an alternative to a trolley-spreader beam-hoist assembly.

FIGS. 3–7 show the sequence of method steps in extracting form panel 45. In FIG. 3 the panel 45 has been lowered away from slab 81 by raising heavy duty shores 71 a couple of feet clear of slab 83 and then lowering screw jacks 65 on legs 61 the desired distance (typically one foot) of separation from slab 81. Also in FIG. 3 panel picker 11 as been flown into position by the crane, held by crane cable 19 and harness 17 and temporarily connected to slab 81 by chain 25 which hooks to insert 29 imbedded in slab 81. In FIG. 4 back handrail 90 on panel 45 is hinged down and the panel 45 rolled out to the first pick-up position. Front pick-up U-bolts 75 on primary girders 51 are located ahead of the front caster wheels 67 so they will be exposed clear of slab 81 edge for pick up before wheels 67 come to the edge of slab 83. The cables 39 from the leading (to the right in FIGS. 3–6) trolley-spreader beam-hoist assembly 31 have been attached to pick-up U-bolts 75 on form panel 45 through small knock-out access doors 77, and raised a few inches until the front caster wheels 67 are clear of slab 83, thereby transferring their load to panel picker 11. At this point the load on panel picker 11 is near the left end, and consequently panel picker 11 is supported by crane cable 19 and wheels 23 bearing on slab 81. In FIG. 5 the panel has been rolled out to the rear pick-up position similar to the first pick-up position in that pick-up U-bolts 75 clear the edge of slab 81 before the rear caster wheels 67 get to the edge of slab 83. As before, the cables 39 from the rear trolley-spreader beam-hoist assembly 31 are attached to rear U-bolts brackets 75 on form panel 45 and raised a few inches until the rear caster wheels 67 clear floor slab 83 now transferring all the weight of form panel 45 to panel picker 11 and in turn to the main crane cable 19. Note that due to the location of panel picker 11 anchoring to slab 81 the panel 45 is now in a balanced position in relation to the main crane cable 19. Also note that just prior to raising the rear caster wheels 77 in FIG. 5 the load on panel picker 11 was near the right end, and consequently panel picker 11 was supported by crane cable 19 and maintained in a horizontal attitude by chain 25 pulling on inserts 29 imbedded in slab 81. Thus during the extraction sequence from FIG. 4 to FIG. 5, the load on picker 11 has shifted from near the left-hand end to near the right-hand end, and the attachment of picker 11 to the slab 81 has shifted from wheel 23 bearing on slab 81 to chain 25 pulling on slab 81 via insert 29. For safety, pins 40 prohibit the rear trolley-spreader beam-hoist assembly 31 from linear movement along picker 11 during lifting operation and thereby prevent panel 45 from moving out of its balanced attitude. Alternatively, non-moving rear assembly 31 may be as shown in FIG. 13 and include girder clamp 120 attached to I-beam 13 and supporting hoist 37. Girder clamp 120 may be loosened and moved along I-beam 13 to the optimal location as described below. In FIG. 6 the panel picker 11/panel 45 combination has been detached from slab 81 and moved laterally by the crane to clear the structure and can now be moved vertically to the next floor above slab 81. In FIG. 7, the crane operator now lowers the panel picker 11/panel 45 combination directly into the position on slab 81 and picker 11 is detached and knock-down access doors 77 replaced. Panel 45 is rolled to its proper lateral position using the swivel caster wheels 67 and raised or lowered to its proper vertical position using the screw jacks 65 on the legs 61. Once this is done heavy duty shores 71 are lowered to the floor to support the concrete load which the panel is now prepared to carry and which will harden to become the slab immediately above slab 81.

Figure 8:
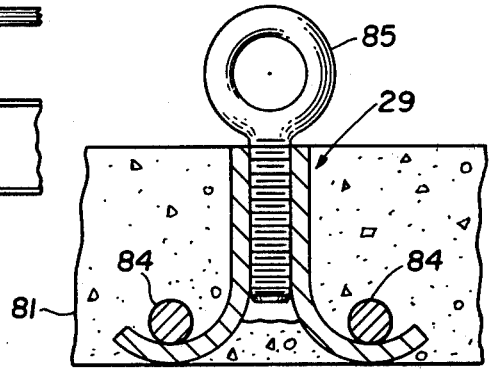
FIG. 8 shows a detailed cross-section of inserts in the slabs for connecting the panel picker.

Panel picker 11 may be used with various length form panels 45 because trolley-spreader hoist-assemblies 31 may be moved along the length of panel picker 11 and hoist 37 may be moved along spreader beams 35 so as to adjust to various form panel 45 widths. In particular, locating pick-up U-bolts 75 approximately 22% of the length of form panel 45 from each end of form panel 45 will minimize the warping and stress on form panel 45 when it is suspended by the crane. This location of pick-up U-bolts 75 together with the requirement that the center of gravity of form panel 45 be directly beneath crane cable 19 during suspension determines the optimal location for panel picker 11 during pick-up as shown in FIGS. 3–5 as follows: the distance from wheel 23 to the edge of slab 81 is equal to M-0.28L where M is the distance from leg 21 to a point below crane cable 19 on I-beam 13 and L is the length of form panel 45. To attach panel picker 11 at this optimal location, inserts 29 are imbedded (usually under reinforcing bars 84) in each slab as it is poured at this optimal location, see FIG. 8 for a cross-section detail of insert 29 in slab 81. The eye portion 85 of insert 29 is unscrewed after use with panel picker 11, so no obstruction remains in slab 81. Such inserts are well known.

Figure 9:
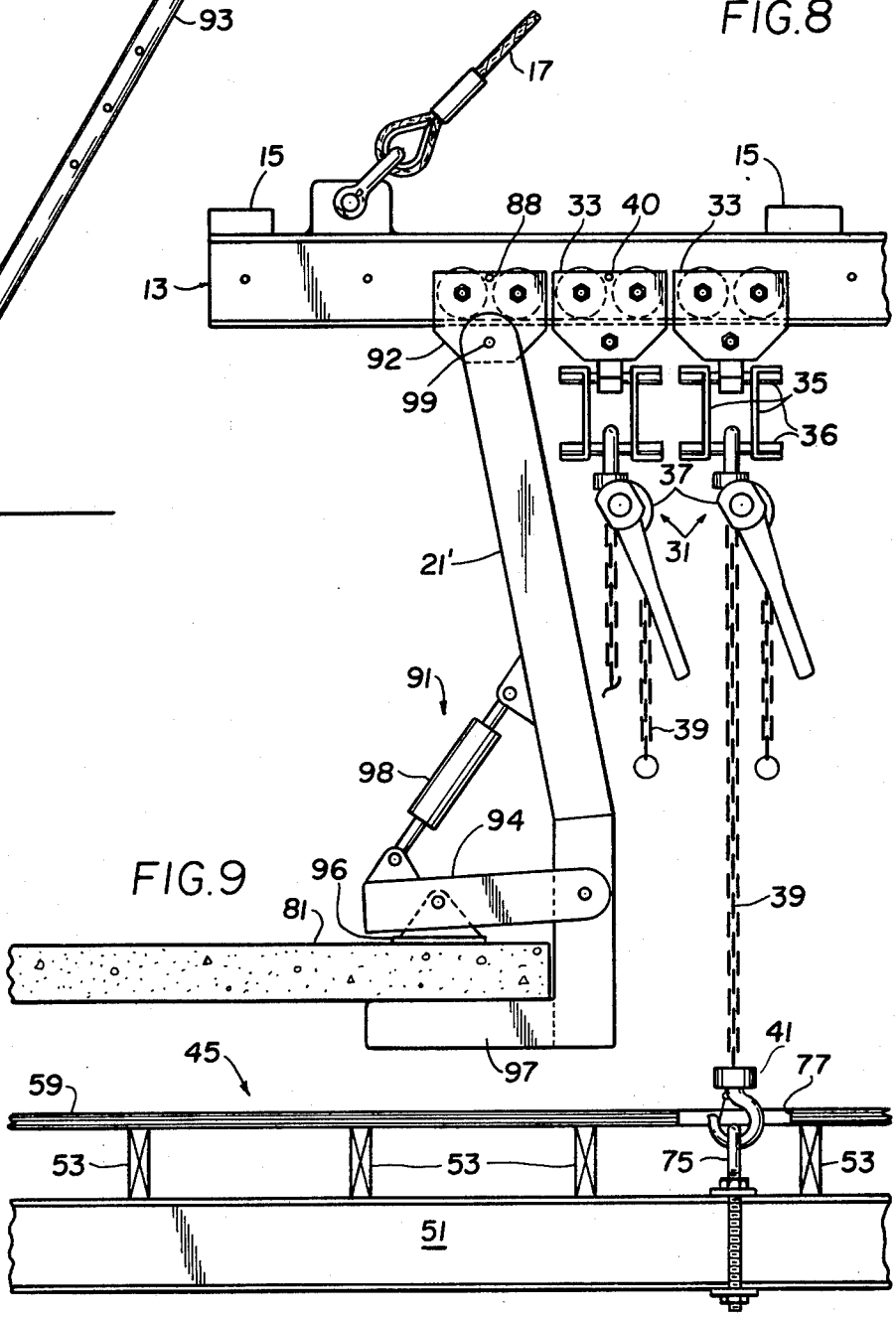
FIG. 9 shows an alternative connection of the panel picker of FIG. 1 to a slab.

As shown in FIG. 9, an alternative to the use of wheel 23, chain 25, turnbuckle 27 and inset 29 to attach panel picker 11 to slab 81 as in FIGS. 3–5 is the use of adjustable jaws 91 at the end of leg 21' to grasp the edge of slab 81. Leg 21' is mounted on trolley 92 which is used to adjust for the length of panel 45 and is pinned in position in I-beam 13 with pin 88 so that crane cable 19 results in the same distance from slab 81 edge for loading, as described previously using the embedded insert 29. Jaw 91 includes fixed bottom 97, pivoting top 94 with pivoting foot 96, and hydraulic ram (double action) 98 to grasp slab 81 between foot 96 and bottom 97. Leg 21' is pivotally mounted on trolley 92 by pin 99; this permits picker 11 to be leveled without over stressing the edge of slab 81 from the leverage picker 11 would apply to jaw 91. Jaws 91 have the advantage of not requiring inserts 29, but the disadvantage of not being a flexible attachment as is the wheel 23, chain 25, turnbuckle 27 and insert 29. Indeed, wheel 23 allows panel picker 11 to be easily maneuvered during the hooking of chain 25 onto insert 29 and the subsequent tightening of wing nut 27.

The panel picker 11 can also be used to transfer loads other than form panels in or out from under a slab above the load, which prohibits direct attachment of the crane cable to the center of gravity of the load. The load must have wheels and pick-up points arranged similar to the form panels described herein or rest on a dolley which does. Picker 11 may have of just one I-beam 13 and a pair of trolley 33-hoist 37 combinations in place of the pair of assemblies 31. In this embodiment hook 41 of hoist 37 would attach to a two-way sling connected to a pair of pick-up U-Bolts 75.

Contrastingly, picker 11 may have three or more I-beams 13 and corresponding assemblies 31 with three trolleys 33. This embodiment may be useful for extra wide panels.

Also, three or more assemblies 31 (or trolley 33-hoist 37 combinations) may be useful for extra long panels.

Figure 10:
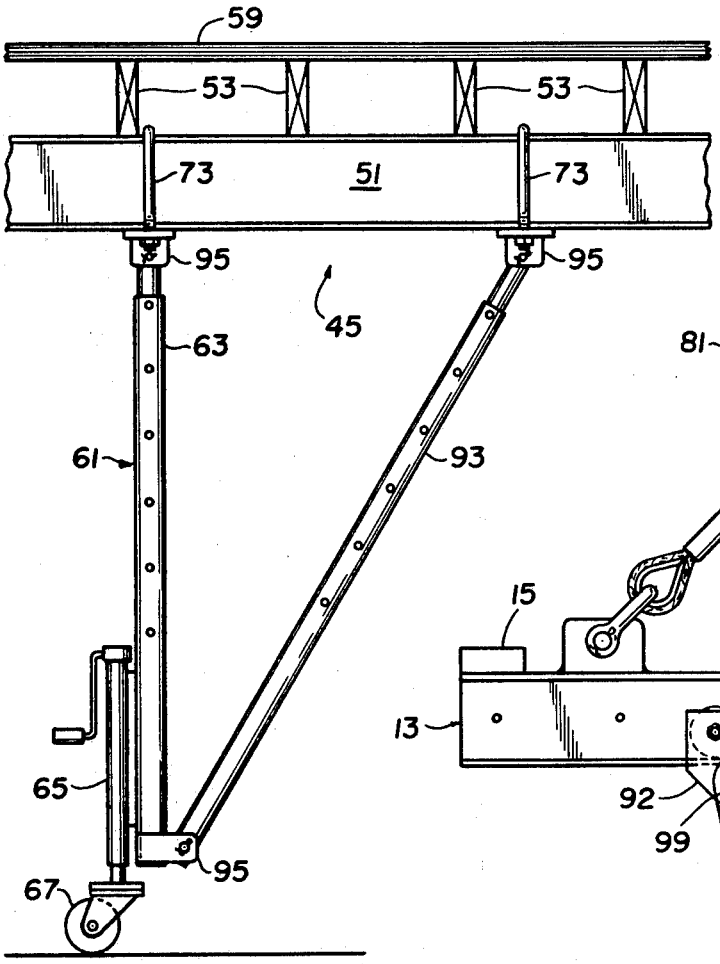
FIG. 10 shows a detail of a leg of the panel of FIG. 2.

FIG. 10 shows a convenient form of telescoping leg 61 which includes two auxiliary telescoping supports 93 one in the plane of the girder 51 and one in the plane of the joists 53 (see FIG. 2) which are pin and bracket 95 mounted at both ends. Leg 61 is also pin and bracket 95 mounted on girder 51, thus leg 61 and supports 93 may easily and quickly be attached and removed from panel 45. The telescoping feature of leg 61 and supports 93 permit quick and easy adjustment to various heights. Also, by telescoping support 93 leg 61 may be swung up to avoid any obstacles such poured rails on slab 83 as panel 45 is extracted as in FIGS. 3–5.

Figure 12:
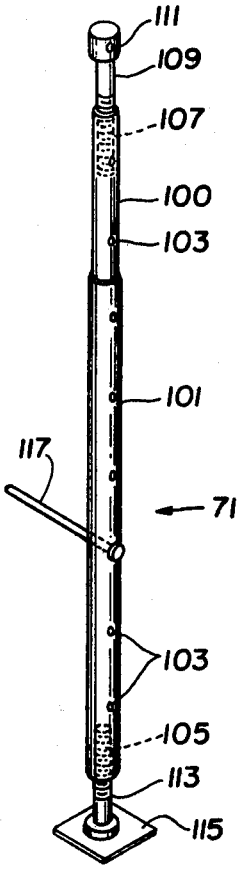
FIG. 12 shows a detailed view of a shore for the form panel of FIG. 2.

FIG. 12 shows a convenient form of shore 71. Shore 71 includes inner tube 100 and outer tube 101 each with pin holes 103. Outer tube 101 has internal left-handed threads 105 and inner tube 100 has internal right-handed threads 107. Threaded end piece 109 engages threads 107 and has a hole 111 for engaging a pin in bracket 95 on primary girder 51. Threaded end piece 113 engages threads 105 and has an attached base plate 115. Alternative forms of base plate 115 may be convenient for special situations such as when shore 71 is used in a non-vertical position as at the edge of slab 81. Shore 71 is adjusted lengthwise by first inserting pin 117 through matching holes 103 in inner tube 100 and outer tube 101. Next pin 117, which extends well beyond outer tube 101, is used as a handle to rotate inner tube 100 and outer tube 101 which endpieces 109 and 113 remain stationary, thereby increasing or decreasing the overall length of shore 71 due to the opposite threadings. Shore 71 also may be swung on pin and bracket 95 to avoid obstacles. Alternatively, shore 71 may be quickly and easily shortened by removing pin 117 and sliding outer tube 101 up inner tube 100 and reinserting pin 117.

What is claimed is:

1. A method for extracting, with a crane, form panels used in forming floor slabs on poured-in-place, multistory concrete structures from beneath the slab last formed on the panels, comprising the steps of:

(a) providing a frame suspended by said crane above the plane of said last formed slab and straddling the periphery of said slab, (b) providing first means for connecting said frame to said slab, (c) using said first means to connect said frame to said slab, (d) providing a plurality of second means for attaching each of said panels to said frame, at least one of said second means movably mounted on said frame, (e) moving one of said panels partially from beneath said last formed slab and partially below said frame, (f) using said movably mounted second means to make a first attachment of said one panel to said frame, (g) moving said one panel further from beneath said last formed slab and concurrently moving said movably mounted second means along said frame so that said first attachment partially supports said one panel, (h) using at least one other of said second means to make at least a second attachment of said one panel to said frame so that said attachments together support said panel, (i) disconnecting said frame from said slab, and (j) moving said frame away from said slab.

2. The method of claim 1, wherein:

(a) said first means for connecting said frame to said slab includes inserts imbedded in said slab.

3. An apparatus for extracting with a crane a form panel from under the slab formed on said panel, comprising:

(a) a frame suspended from said crane, (b) means for connecting said frame to said slab, (c) a plurality of means for attaching said form panel to said frame, at least one of said means for attaching movably mounted on said frame so that:

(i) said panel may be partially moved from under said slab, (ii) said movably mounted means may attach said panel at a point not under said slab to said frame, (iii) said panel may be further moved from under said slab and said movably mounted means simultaneously moved along said frame while preserving said attachment, and (iv) a second of said plurality of means may attach said panel at a point not under said slab to said frame and thereby said panel is held by said frame suspended from said crane.

* * * * *